US010794245B2

(12) United States Patent
Fischer et al.

(10) Patent No.: US 10,794,245 B2
(45) Date of Patent: Oct. 6, 2020

(54) DEVICE FOR THE VENTILATION OF A CRANKCASE OF AN INTERNAL COMBUSTION ENGINE

(71) Applicant: Bayerische Motoren Werke Aktiengesellschaft, Munich (DE)

(72) Inventors: Stefan Fischer, Seefeld (DE); Christa Roddewig, Spangenberg (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 19 days.

(21) Appl. No.: 16/257,196

(22) Filed: Jan. 25, 2019

(65) Prior Publication Data

US 2019/0170033 A1 Jun. 6, 2019

Related U.S. Application Data

(63) Continuation of application No. PCT/EP2017/071181, filed on Aug. 23, 2017.

(30) Foreign Application Priority Data

Oct. 6, 2016 (DE) ..... 10 2016 219 344

(51) Int. Cl.
*F01M 13/04* (2006.01)
*F01M 11/02* (2006.01)
(Continued)

(52) U.S. Cl.
CPC ..... *F01M 13/04* (2013.01); *F01M 11/02* (2013.01); *F01M 13/00* (2013.01);
(Continued)

(58) Field of Classification Search
CPC ..... F01M 13/04; F01M 13/022; F01M 2013/027; F01M 11/02; F01M 13/00; F01M 2013/0038; F01M 2013/0044
(Continued)

(56) References Cited

U.S. PATENT DOCUMENTS 6,234,154 B1 * 5/2001 Spix ..... F01M 13/022 123/572
6,279,554 B1 8/2001 Sayama et al.
(Continued)

FOREIGN PATENT DOCUMENTS

DE 101 63 781 A1 7/2003
DE 600 13 923 T2 1/2005
(Continued)

OTHER PUBLICATIONS

International Search Report (PCT/ISA/210) issued in PCT Application No. PCT/EP2017/071181 dated Nov. 17, 2017 with English translation (four (4) pages).
(Continued)

*Primary Examiner* — Syed O Hasan
(74) *Attorney, Agent, or Firm* — Crowell & Moring LLP

(57) ABSTRACT

An internal combustion engine having an engine block, a cylinder head, a crankcase and at least one cylinder includes a crankcase ventilation line connected to at least one intake line. The crankcase ventilation line is arranged at least predominantly within the internal combustion engine, in particular within the engine block and/or within the cylinder head, thereby greatly minimizing or eliminating the potential for release of crankcase gas to the environment.

9 Claims, 3 Drawing Sheets

(51) Int. Cl.
*F01M 13/00* (2006.01)
*F01M 13/02* (2006.01)

(52) U.S. Cl.
CPC ... *F01M 13/022* (2013.01); *F01M 2013/0038* (2013.01); *F01M 2013/0044* (2013.01); *F01M 2013/027* (2013.01)

(58) Field of Classification Search
USPC ..... 123/572–574
See application file for complete search history.

(56) References Cited

U.S. PATENT DOCUMENTS 7,047,955 B2 * 5/2006 Ookawa ..... F01M 13/022 123/572
8,919,329 B2 * 12/2014 Lohr ..... F01M 13/0405 123/572
8,936,013 B2 * 1/2015 Fleck ..... F02M 35/10222 123/572
2010/0313860 A1 12/2010 Miller et al.
2013/0112159 A1 5/2013 Lohr et al.
2014/0130493 A1 * 5/2014 Spix ..... F01M 13/023 60/599
2014/0158096 A1 6/2014 Leone et al.
2014/0318514 A1 * 10/2014 Pursifull ..... F01M 13/022 123/568.29
2015/0053188 A1 * 2/2015 Kuribayashi ..... F02B 37/183 123/574
2015/0159596 A1 6/2015 Wakiya
2015/0247432 A1 * 9/2015 Fujikawa ..... F01M 13/023 123/573
2016/0097354 A1 * 4/2016 Martus ..... F02M 35/10222 123/572

FOREIGN PATENT DOCUMENTS

DE 10 2004 012 160 A1 9/2005
DE 20 2004 011 882 U1 1/2006
DE 101 25 312 B4 4/2009
DE 10 2010 023 822 A1 2/2011
DE 10 2012 220 141 A1 5/2013
DE 10 2013 224 919 A1 6/2014
DE 10 2014 013 714 A1 3/2016
DE 10 2014 114 397 A1 4/2016
EP 1 522 713 A2 4/2005

OTHER PUBLICATIONS

German-language Written Opinion (PCT/ISA/237) issued in PCT Application No. PCT/EP2017/071181 dated Nov. 17, 2017 (four (4) pages).
German-language Search Report issued in counterpart German Application No. 10 2016 219 344.9 dated Sep. 1, 2019 with partial English translation (14 pages).

* cited by examiner

DEVICE FOR THE VENTILATION OF A CRANKCASE OF AN INTERNAL COMBUSTION ENGINE

CROSS REFERENCE TO RELATED APPLICATIONS

This application is a continuation of PCT International Application No. PCT/EP2017/071181, filed Aug. 23, 2017, which claims priority under 35 U.S.C. § 119 from German Patent Application No. 10 2016 219 344.9, filed Oct. 6, 2016, the entire disclosures of which are herein expressly incorporated by reference.

BACKGROUND AND SUMMARY OF THE INVENTION

The invention relates to a device for the ventilation of a crankcase of an internal combustion engine, in particular a crankcase ventilation line.

In internal combustion engines, in particular in those for motor vehicles with pistons and/or cylinders, gas can accumulate in a crankcase. The term crankcase gas is also used. This usually occurs in that the crankcase gas moves out of a combustion chamber (or the cylinder) through a gap and past a piston and into the interior of the crankcase. The crankcase gas is frequently also referred to as "blow-by gas". It is not subjected to exhaust gas purification before it arrives in the crankcase. Furthermore, it frequency contains a high proportion of unburned or incompletely burnt components. Therefore, the crankcase gas from the crankcase should not escape into the surroundings. The crankcase gas should, however, be let out of the (usually airtight) crankcase in order to avoid build up of pressure in the crankcase. A build up of pressure is to be avoided, in particular, in order to avoid damage to the components of an internal combustion engine and their attachments. This applies, in particular, to seals.

Internal combustion engines are known in which the crankcase gas is removed from the crankcase and fed again to the combustion chambers, with the result that after renewed combustion in the combustion chambers it can be fed to an exhaust gas system for exhaust gas after-treatment (e.g. by means of a catalytic converter). This concept is frequently legally required in internal combustion engines and is referred to as "crankcase ventilation".

For this purpose, known systems have lines which are arranged externally on the crankcase and can be composed e.g. of rubber. Such lines have the disadvantage that when they have leaks crankcase gas can escape from them. In particular, this is disadvantageous owing to legal requirements and/or for reasons of protecting the environment.

In known systems, a diagnosis of the tightness of the crankcase ventilation lines is either not possible or is able to be implemented only at great expense (under certain circumstances by means of additional sensors). Even if a leak is detected, in such systems the possibility of the internal combustion engine continuing to at least temporarily operate with the leak is not excluded.

Taking this as a basis, the object of the present invention is to further solve or at least alleviate the technical problems which are described in conjunction with the prior art. The intention is to present, in particular, an internal combustion engine in which the risk of a leak via which crankcase gas can escape into the environment is greatly reduced and, under certain circumstances, even excluded, with the result that a complex diagnosis can also be dispensed with.

The device according to the invention is an internal combustion engine having an engine block and a cylinder head. At least one crankcase and at least one cylinder, which is connected to at least one intake line, are arranged in the internal combustion engine. The crankcase is connected to the at least one intake line via a crankcase ventilation line. The crankcase ventilation line is arranged at least mainly inside the internal combustion engine, in particular inside the engine block and/or inside the cylinder head.

The internal combustion engine can be, for example, an internal combustion engine for a motor vehicle. The cylinder or the cylinders form the combustion chamber/the combustion chambers of the internal combustion engine in which fuel can be burnt with air. The engine block surrounds the cylinders. The engine block is preferably implemented as a cast part. The cylinder head closes off the engine block. In addition to the engine block, the internal combustion engine has a cylinder head which is preferably also implemented as a cast part. The engine block and the cylinder head are permanently connected to one another. The at least one cylinder is preferably arranged inside the engine block and is closed off at one end by the cylinder head. The crankcase forms a space which is bounded by the engine block and/or by the cylinder head. The crankcase forms a cavity inside the engine block and/or inside the cylinder head in which crankcase gas can collect.

The at least one cylinder is supplied with air via the at least one intake line. The at least one intake line can be embodied, for example, as a pipe between the surroundings of the motor vehicle and the at least one cylinder. At least one of the following components is preferably arranged in the at least one intake line:

an air filter, a throttle valve, and a cooling device.

In order to extract gas which is collected in the crankcase from the crankcase and to feed it again to the combustion, the crankcase ventilation line is provided. The latter is preferably connected to the crankcase in which the crankcase gases can collect. Furthermore, the crankcase ventilation line is preferably connected to the intake line in such a way that crankcase gases are sucked into the intake line owing to an underpressure prevailing in the intake line. The term "underpressure" is meant here to refer to a negative pressure level relative to the pressure level in the crankcase. This means, in particular, also that the crankcase ventilation line is preferably connected to a point on the intake line at which a lower pressure is present (at least temporarily) in the intake line than in the crankcase. In the case of internal combustion engines which have different pressure distributions in the intake line in different operating states, the crankcase ventilation line is preferably embodied in such a way that crankcase gas can be fed to another point on the intake line depending on the operating state of the crankcase gas. For this purpose, for example a system composed of a plurality of branched crankcase ventilation lines or branchings may be provided on the crankcase ventilation line, which branched crankcase ventilation lines or branchings can be controlled by means of valves or flaps in such a way that depending on the operating state of the internal combustion engine a flow path for the crankcase gas which is provided for this operating state between the crankcase and the intake line is opened.

In order to be able to avoid the problem described above that crankcase gas can pass into the environment (in particular if a line is not correctly connected), the crankcase ventilation line is arranged at least mainly inside the engine block inside or the cylinder head.

The arrangement of the crankcase ventilation line in the engine block or in the cylinder head is preferably implemented in such a way that gas cannot escape into the environment from the crankcase ventilation line. The ventilation of the crankcase preferably takes place exclusively inside the engine block or inside the cylinder head, with the result that the crankcase gas can be removed from the crankcase and can be conducted through the crankcase ventilation line into a region of the intake line arranged inside the crankcase, without exiting the engine block and the cylinder head. In this way it is possible to ensure that the crankcase gas cannot escape into the environment.

The crankcase ventilation line being at least mainly arranged inside the engine block or the cylinder head means that at least 50%, preferably at least 75% and particularly preferably at least 90%, of the crankcase ventilation line is arranged inside the engine block or the cylinder head. The percentages relate to the length of the crankcase ventilation line measured along the profile of the crankcase ventilation line. The percentages give the proportion of the entire crankcase ventilation line (which can be composed of a plurality of branches) which is made up by the portion of the crankcase ventilation line which is arranged inside the engine block or the cylinder head.

In one preferred embodiment, the internal combustion engine also has a compressor for compressing air in the intake line, wherein the crankcase ventilation line is branched and is connected to at least one first connection point on the intake line downstream of the compressor, and a line branch, which is connected to at least one second connection point upstream of the compressor, branches off at a branching point.

The connection between the crankcase ventilation line and the intake line is preferably arranged at the inlet into a compressor for compressing the intake air. The inlet line of the crankcase gas into the compressor inlet is an integral component of the compressor, irrespective of the type of charging element with which the compressor is implemented (whether turbocharger or compressor). A connection of the crankcase ventilation line of the intake line at the inlet point cannot be released or is a fixed component of the mounting of the internal combustion engine. The same applies to a connection of the crankcase ventilation line and of the crankcase (at an output of the crankcase from the engine). This connection also cannot be released or is a fixed component of the mounting.

The compressor can be, for example, an exhaust gas turbocharger. In the case of an internal combustion engine with a compressor it is possible to differentiate between a supercharged operating mode (in which the air in the intake line is compressed with the compressor so that the air is forced into the cylinder or the cylinders) and the suction operating mode (in which no compression takes place and the air is sucked into the cylinder or cylinders). In the suction operating mode, a underpressure (that is to say a lower pressure than in the crankcase), which is suitable for the ventilation of the crankcase, is present in the intake regions of the cylinders. Therefore, in the suction operating mode a crankcase ventilation line which is connected to the intake region of the cylinders is preferably used. This is also made possible here by the part of the crankcase ventilation line which is connected to the at least one first connection point on the intake line downstream of the compressor. The term "downstream" here means located afterward in the direction of flow (the one which is usually present). That is to say the at least one first connection point is therefore arranged here between the compressor and the cylinder or the cylinders.

On the other hand, in the supercharged operating mode the pressure in the intake line is increased downstream of the compressor by the compressor, with the result that ventilation of the crankcase is not possible via this part of the crankcase ventilation line. The ventilation of the crankcase preferably takes place in the supercharged operating mode via the line branch which is connected to the at least one second connection point upstream of the compressor. In the supercharged operating mode, a underpressure (that is to say a lower pressure than in the crankcase), which is suitable for ventilating the crankcase, is present upstream of the compressor. This occurs, in particular, owing to the fact that the compressor sucks in the air to be compressed and as a result generates the underpressure upstream. In the suction operating mode an underpressure is usually also present at the at least one second connection point. This underpressure is, however, lower than the underpressure which is then present at the first connection point downstream of the compressor. Therefore, branching of the crankcase ventilation line is therefore advantageous, said branching permitting temporary sucking away at the first intake point and temporary sucking away at the second intake point.

Depending on the operating state of the internal combustion engine, the ventilation of the crankcase can preferably take place either via one branch or via both branches of the crankcase ventilation line. For this purpose, preferably a valve (flap) or changeover switch is provided, in particular at the branching point. It is possible for the valve itself to constitute the branching point. The valve can be passive or switchable. A passive valve is moved to the desired position directly by the pressure differences which occur at the various intake points. An active valve is actively (if appropriate electronically) actuated in order to establish a connection with the desired intake point.

In a further preferred embodiment of the internal combustion engine, a multiplicity of cylinders are provided. At least one first connection point is provided for each of the cylinders.

The intake line is preferably branched in such a way that it it individually connected to the respective intake region of each cylinder via a corresponding branch. The respective first connection point of a cylinder is preferably arranged in the corresponding branch of the intake line. As a result, the crankcase gas can be distributed uniformly among all the cylinders. This applies at any rate in the suction operating mode of the internal combustion engine in which the ventilation of the crankcase takes place via the first connection points.

In a further preferred embodiment of the internal combustion engine, the line branch is arranged partially outside the internal combustion engine and is connected to the intake line via a non-releasable connection at the first connection point.

The formulation "outside the internal combustion engine" means, in particular, that the line branch is not arranged inside the engine block and not inside the cylinder head.

The design of the internal combustion engine can result in the intake line being arranged in such a way that the line branch has to be run at least partially outside the crankcase. This can apply, in particular, if a compressor is not integrally formed directly onto the engine block or onto the cylinder head. This external part of the line branch is preferably kept as short as possible. At least the external part of the line branch is preferably fabricated from a material and embodied (in particular in respect of a material thickness of a line wall) in such a way that a seal is ensured over an entire life cycle of the motor vehicle. In particular, it is preferred that the material of the external part of the line branch selected has good ageing performance, with and good material properties which are relevant for the seal of a line (porosity, rigidity, flexibility, brittleness, permeability to gases, etc.). It is also possible for the external part of the line branch to be formed from a combination of a plurality of coaxially arranged lines which in their entirety particularly reliably prevent gas from escaping from the interior of the line branch. This line branch is also preferably releasable in itself, and is, if appropriate, connected in a materially joined fashion to the parts of the crank shaft ventilation line which are arranged inside the internal combustion engine.

A non-releasable connection is to be understood in the present sense as meaning that when repair measures are carried out the supercharging element and the engine-internal crankcase ventilation line are inevitably joined.

The non-releasable connection is preferably also to be understood as being such a connection which cannot be released without damaging a component, in particular the crankcase ventilation line, the intake line and a connection line which is, if appropriate, arranged between them. This can ensure that after works-side mounting (during which e.g. testing of the seal is carried out) the connection can no longer be released. There is then also no risk of an only partial, incomplete connection when the connection is restored. The non-releasable connection is preferably embodied in such a way that it cannot and also does not need to be released over the entire service life of the motor vehicle. In particular it is preferred that the internal combustion engine is constructed in such a way that all the possible repairs (comprising, for example, the removal and installation of components) can be carried out without the presence of a non-releasable connection being an impediment in this context.

In a further preferred embodiment of the internal combustion engine, the line branch is arranged at maximum 25% outside the crankcase. A portion of the line branch outside the crankcase is preferably made as short as is technically possible.

The specified condition relates to a length of the line branch which is measured along the profile of the line branch. With a line branch which is selected to be so short, the risk of a leak in the part of the line branch arranged outside the crankcase can be reduced. It is preferred that even only at maximum 5% of the line branch is arranged outside the crankcase. Furthermore, it is preferred that the part of the line branch which is arranged outside the engine block or the cylinder head is at maximum 20 cm [centimeters], in particular only 10 cm long.

In a further preferred embodiment of the internal combustion engine, the line branch has a non-return valve (flap) which is arranged inside the internal combustion engine. In further variants, it is however also possible to embody a non-return valve as an integral component of a compressor (in particular of a compressor arch).

The formulation "inside the internal combustion engine" is intended to mean, in particular, that the line branch is arranged inside the engine block or inside the cylinder head (also referred to as cylinder head hood or valve cover).

As described further above, the crankcase ventilation line is configured to conduct gas from the crankcase into the intake line. However, the pressure in the intake line can also be higher than the pressure in the crankcase, depending on the operating state of the internal combustion engine. This applies, in particular, to the pressure downstream of a compressor. In this case, air could pass via the crankcase ventilation line into the crankcase and increase the pressure there.

In particular, as described air can pass from the intake line into the crankcase via the line branch. Therefore, the non-return valve is provided in the line branch. The forward direction of the non-return valve is preferably oriented from the branching point toward the second connection point. The non-return valve preferably makes it possible, in particular with the described orientation of the forward direction, to prevent air from passing from the intake line into the crankcase, as described. Arranging the non-return valve inside the internal combustion engine can, in particular with this component which is susceptible to leaks, considerably reduce the risk of a leak and therefore of crankcase gas escaping. The non-return valve is preferably integrated into the internal combustion engine in such a way that it is impossible for gas to escape from the non-return valve (flap) into the environment.

In a further preferred embodiment of the internal combustion engine, a regulating valve (also referred to as regulating unit), via which the crankcase ventilation line is connected to the crankcase, is provided inside the internal combustion engine.

The formulation "inside the internal combustion engine" is intended to mean in particular that the regulating valve (regulating unit) is arranged inside the internal combustion engine, in particular inside the engine block or inside the cylinder head.

A regulating valve (regulating unit) is meant to refer here to a device with which ventilation of the crankcase via the crankcase ventilation line can be controlled in a targeted fashion, for example by means of an electronic regulating intervention.

The regulating valve (regulating unit) is preferably configured to keep a pressure in the crankcase at a desired level or below a desired level. Furthermore, it is preferred that the regulating valve (regulating unit) serves to perform the switching over as described further above (in different operating states of the internal combustion engine) between the branches of the crankcase ventilation line. The regulating valve (regulating unit) preferably has an inlet which is connected to the crankcase which is to be ventilated. Furthermore, the regulating valve preferably has two outlets, one for each of the branches of the crankcase ventilation line. In the case of a crankcase ventilation line with more than two branches, the regulating valve preferably has one outlet for each branch of the crankcase ventilation line. The regulating valve is preferably arranged inside the crankcase. As is also the case with the non-return valve described further above, this makes it possible to ensure that a leak of the regulating valve is avoided. The regulating valve is preferably integrated into the internal combustion engine in such a way that it is impossible for gas to escape from the regulating valve into the environment.

The regulating valve can prevent the pressure in the crankcase from becoming too low. The production of crankcase gas to an undesired degree can be boosted by an excessively low pressure in the crankcase since gas from the cylinders is actively sucked past the piston and into the crankcase. Furthermore, a particularly low pressure can also give rise to damage to other components such as seals, which damage can be avoided by using a regulating valve.

The regulating valve is preferably a PCV valve. The regulating valve can be volume-flow or mass-flow-regulated or pressure-regulated.

In a further preferred embodiment of the internal combustion engine, the part of the crankcase ventilation line which runs inside the engine block and/or the cylinder head is implemented as cutouts inside the material of the engine block and/or of the cylinder head.

A line which is implemented by means of cutouts in a block of material can at any rate not leak between its ends. Therefore, in this embodiment the escape of a crankcase gas can be prevented particularly effectively.

In a further preferred embodiment of the internal combustion engine, the crankcase ventilation line is implemented as an integrally cast or drilled duct.

If the engine block and/or the cylinder head are/is implemented as a cast part or as two cast parts, a duct which is integrally cast therein is particularly well protected against leaking.

The invention is preferably used in a motor vehicle with an internal combustion engine as described above.

The particular advantages and configuration features which are described further above for the internal combustion engine can be applied and transferred to the motor vehicle described.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
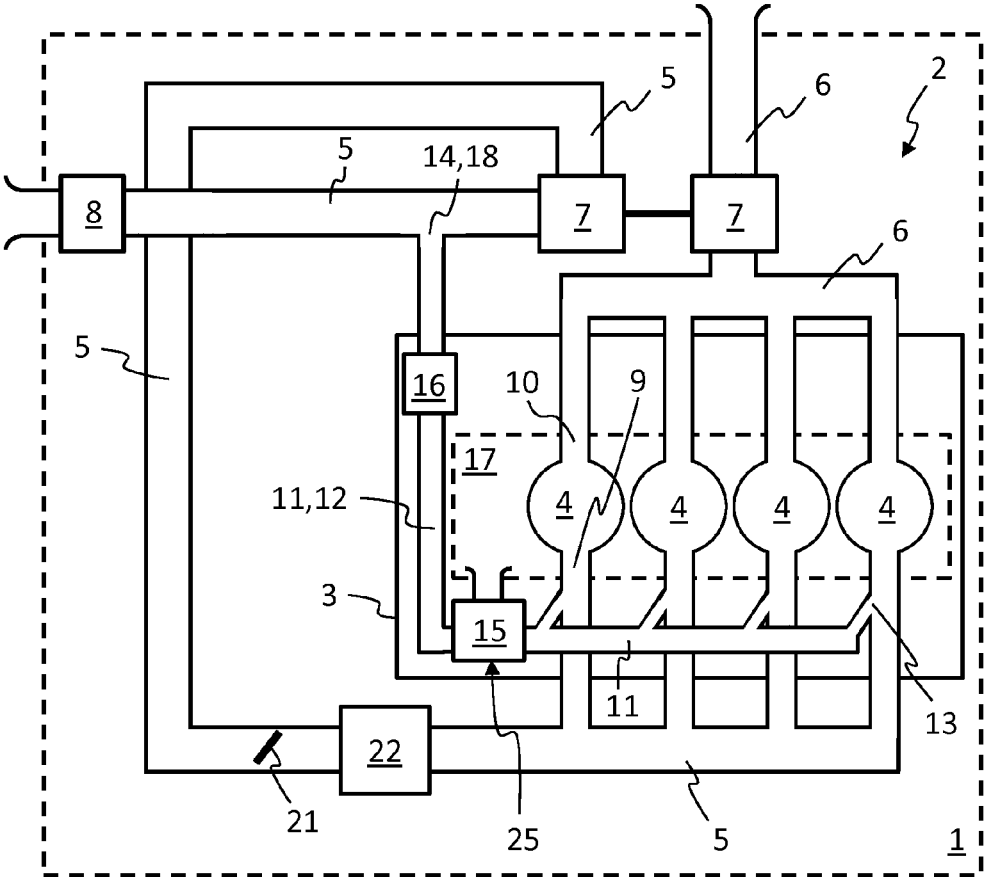
FIG. 1 shows a schematic illustration of a motor vehicle with an internal combustion engine.

FIG. 1 is a schematic view of a motor vehicle 1 with an internal combustion engine 2 having a crankcase 3 with a cavity 17. Arranged on the crankcase 3 are four cylinders 4 which are each connected to an intake line 5 via an intake region 9. The intake line 5 has an air filter 8, a throttle valve 21 and a cooling device 22. Furthermore, the cylinders 4 are connected to an exhaust gas line 6 via outlet regions 10.

A compressor 7 which is embodied as an exhaust gas turbocharger is connected both to the intake line 5 and to the exhaust gas line 6. A crankcase ventilation line 11 is arranged mainly inside the internal combustion engine 2. The crankcase ventilation line 11 is connected to the four first connection points 13 to the intake line 5 in the intake regions 9 downstream of the compressor 7. A line branch 12 of the crankcase ventilation line 11 branches off at a branching point 25. The line branch 12 is connected to the intake line 5 at a second connection point 14, embodied as a non-releasable connection 18, upstream of the compressor 7. A regulating valve 15 is arranged at the branching point 25. The line branch 12 has a non-return valve 16 inside the internal combustion engine 2. The forward direction of the non-return valve 16 is oriented from the branching point 25 toward the second connection point 14.

Figure 2:
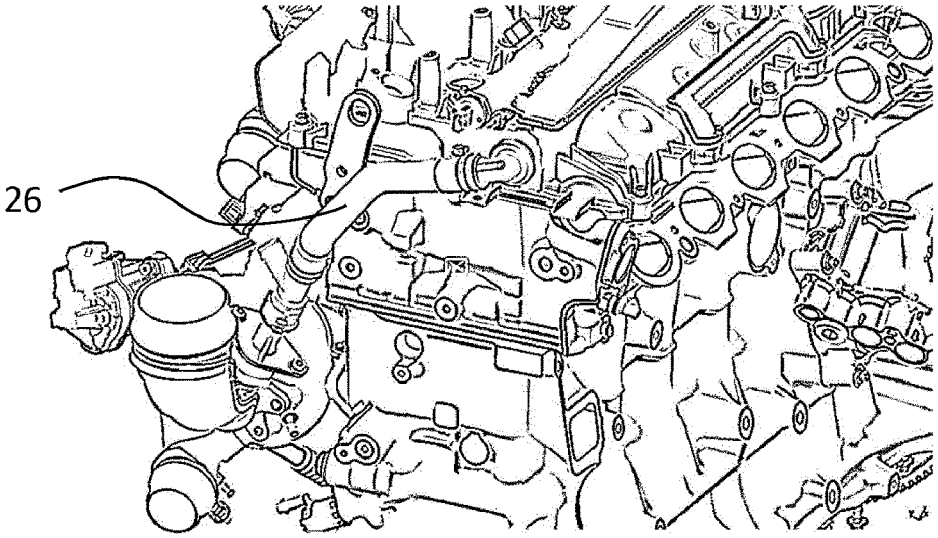
Fig. 2 (Prior art)
FIG. 2 shows a perspective illustration of an internal combustion engine having a crankcase ventilation line according to the prior art.

FIG. 2 shows an internal combustion engine 2 according to the prior art. An external line 26, which is embodied as a rubber hose, can be seen. The external line 26 is connected externally to a crankcase 3 and to an intake line 5 via releasable connections, and serves to ventilate the crankcase 3. The external line 26 cannot reliably prevent crankcase gas from escaping into the environment, and diagnosis for a leak is possible only at high cost.

Figure 3:
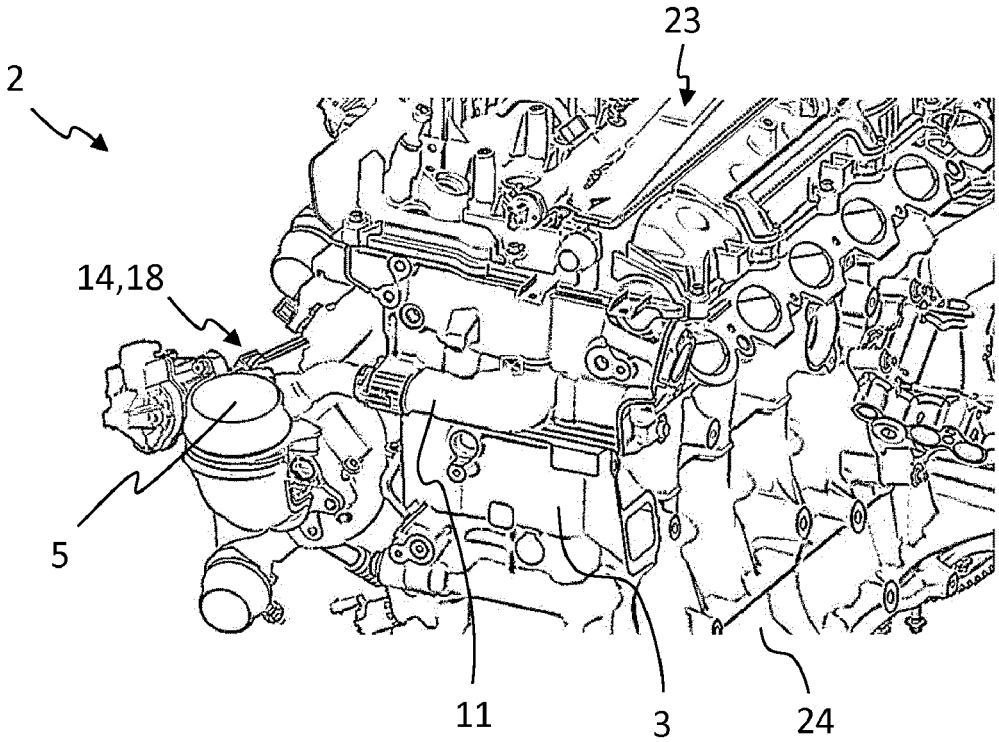
FIG. 3 shows a perspective illustration of a described internal combustion engine with a crankcase ventilation line.

FIG. 3 shows an internal combustion engine 2, as described above, with a crankcase 3. A crankcase ventilation line 11 is arranged mainly inside an engine block 24 and/or a cylinder head 23. Furthermore, the crankcase ventilation line 11 is connected here to an intake line 5 via a non-releasable connection 18 at a second connection point 14.

Figure 4:
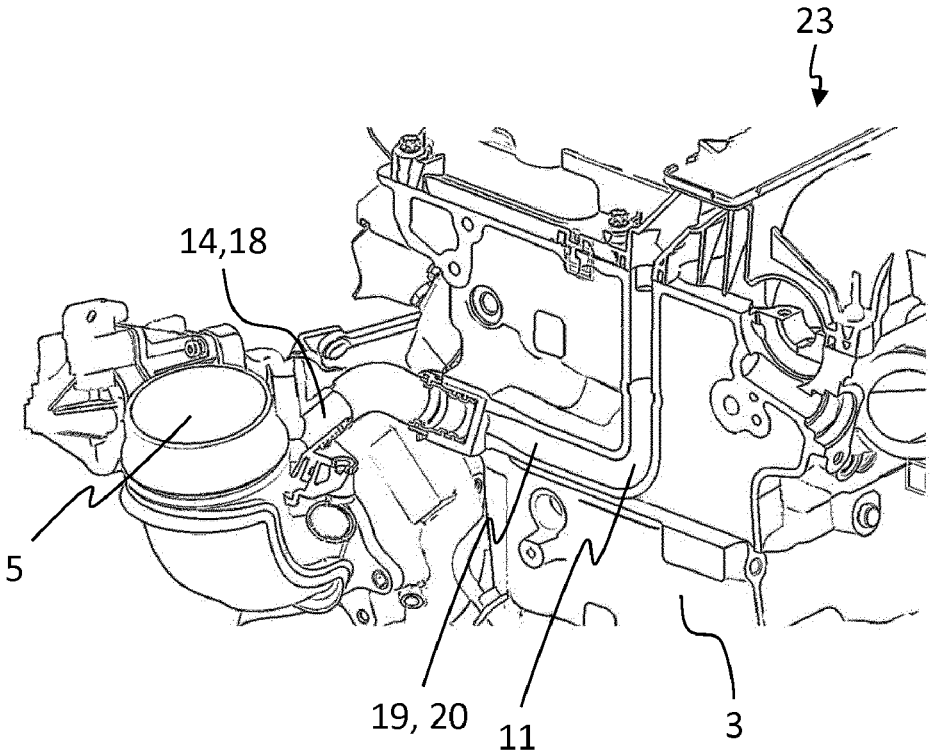
FIG. 4 shows a sectional illustration of the internal combustion engine from FIG. 3.

FIG. 4 shows the internal combustion engine 2 from FIG. 3 in a more detailed illustration. It is apparent that the crankcase ventilation line 11 is implemented with cutouts 19 which form an integrally cast duct 20.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMBERS

1 Motor vehicle
2 Internal combustion engine
3 Crankcase
4 Cylinder
5 Intake line
6 Exhaust gas line
7 Compressor
8 Air filter
9 Intake region
10 Outlet region
11 Crankcase ventilation line
12 Line branch
13 First connection point
14 Second connection point
15 Regulating valve
16 Non-return valve
17 Cavity
18 Non-releasable connection
19 Cutout
20 Integrally cast duct
21 Throttle valve
22 Cooling device
23 Cylinder head
24 Engine block
25 Branching point
26 External line

What is claimed is:

1. An internal combustion engine, comprising:

an engine block having a crankcase, at least one cylinder and a crankcase ventilation line;

a cylinder head arranged on the engine block over the at least one cylinder and connected to at least one intake line;

a compressor arranged to compress air in the at least one intake line;

a regulating valve in the crankcase ventilation line inside one or both of the engine block and the cylinder head, the regulating valve having a crankcase ventilation line inlet configured to receive crankcase vapors from the crankcase, a first regulating valve outlet separate from the crankcase ventilation line inlet from which a branching point extends, separate from the crankcase ventilation line inlet, to at least one first connection point on the intake line downstream of the compressor, and a second regulating valve outlet separate from the crankcase ventilation line inlet from which a separate line branch branches to at least one second connection point upstream of the compressor; and a non-return valve arranged in the line branch between the regulating valve and the at least one second connection point to prevent flow from the at least one second connection point to the branching point, wherein the crankcase is fluidly connected to the at least one intake line via the crankcase ventilation line, and the crankcase ventilation line is arranged substantially entirely inside one or both of the engine block and the cylinder head.

2. The internal combustion engine as claimed in claim 1, wherein the at least one cylinder is a plurality of cylinders, and the at least one first connection point includes a respective first connection point for each of the plurality of cylinders.

3. The internal combustion engine as claimed in claim 1, wherein the line branch is arranged partially outside the internal combustion engine and is connected to the intake line at the at least one first connection point via a non-releasable connection.

4. The internal combustion engine as claimed in claim 3, wherein a portion of the line branch outside of the engine block and cylinder head is at most 25% of the crankcase ventilation line.

5. The internal combustion engine as claimed in claim 1, wherein the non-return valve arranged in a portion of the line branch is inside one or both of the engine block and the cylinder head.

6. The internal combustion engine as claimed claim 1, wherein a portion of the crankcase ventilation line inside one or both of the engine block and the cylinder head is formed by cutouts inside the material of one or both of the engine block and the cylinder head.

7. The internal combustion engine as claimed claim 5, wherein a portion of the crankcase ventilation line inside one or both of the engine block and the cylinder head is formed by cutouts inside the material of one or both of the engine block and the cylinder head.

8. The internal combustion engine as claimed in claim 1, wherein at least a portion of the crankcase ventilation line is an integrally cast duct.

9. A motor vehicle, comprising:

an internal combustion engine including an engine block having a crankcase, at least one cylinder and a crankcase ventilation line, a cylinder head arranged on the engine block over the at least one cylinder and connected to at least one intake line, a compressor arranged to compress air in the at least one intake line, a regulating valve in the crankcase ventilation line inside one or both of the engine block and the cylinder head, the regulating valve having a crankcase ventilation line inlet configured to receive crankcase vapors from the crankcase, a first regulating valve outlet separate from the crankcase ventilation line inlet from which a branching point extends, separate from the crankcase ventilation line inlet, and a second regulating valve outlet separate from the crankcase ventilation line inlet from which a separate line branch branches to at least one second connection point upstream of the compressor, and a non-return valve arranged in the line branch between the regulating valve and the at least one second connection point to prevent flow from the at least one second connection point to the branching point, wherein the crankcase fluidly connected to the at least one intake line via the crankcase ventilation line, and the crankcase ventilation line is arranged substantially entirely inside one or both of the engine block and the cylinder head.

* * * * *